US005907959A

United States Patent [19]

Agrawal et al.

[11] Patent Number: 5,907,959

[45] Date of Patent: Jun. 1, 1999

[54] AIR SEPARATION PROCESS USING WARM AND COLD EXPANDERS

[75] Inventors: Rakesh Agrawal, Emmaus; Donn Michael Herron, Fogelsville, both of Pa.

[73] Assignee: Air Products and Chemicals, Inc., Allentown, Pa.

[21] Appl. No.: 09/010,958

[22] Filed: Jan. 22, 1998

[51] Int. Cl.[6] ..... F25J 3/00

[52] U.S. Cl. ..... 62/646; 62/652

[58] Field of Search ..... 62/646, 652

[56] References Cited

U.S. PATENT DOCUMENTS

| | | | |
|---|---|---|---|
| 2,753,698 | 7/1956 | Jakob | 62/123 |
| 4,410,343 | 10/1983 | Ziemer | 62/29 |
| 4,543,115 | 9/1985 | Agrawal et al. | 62/25 |
| 4,704,148 | 11/1987 | Kleinberg | 62/24 |
| 4,883,519 | 11/1989 | Agrawal et al. | 62/646 |
| 4,936,099 | 6/1990 | Woodward et al. | 62/24 |
| 4,964,901 | 10/1990 | Rhode | 62/13 |
| 5,146,756 | 9/1992 | Lavin | 62/24 |
| 5,309,721 | 5/1994 | Rathbone | 62/39 |
| 5,396,772 | 3/1995 | McKeigue et al. | 62/652 |

FOREIGN PATENT DOCUMENTS

| | | | |
|---|---|---|---|
| 2854508 | 6/1980 | Germany | F25J 3/02 |
| 8800677 | 1/1988 | WIPO | F25J 3/02 |

*Primary Examiner*—Ronald Capossela
*Attorney, Agent, or Firm*—Willard Jones, II

[57] ABSTRACT

The present invention relates to a process for the cryogenic distillation of air in a distillation column system having at least one distillation column operating at a higher pressure and one distillation column operating at a lower pressure, wherein feed air is cooled and fed to the higher pressure column, wherein the boil-up at the bottom of the lower pressure column producing the oxygen product is provided by condensing a stream having a nitrogen concentration equal to or greater than that of the feed air stream and wherein at least two expanders are employed to provide refrigeration to the distillation column system, wherein the first expander is operated at an inlet temperature near ambient or above ambient temperature and the second expander is operated at an inlet temperature colder than ambient, characterized in that at least one of the two expanders employs at least one of the following steps: (a) work expanding a portion of the feed air; (b) work expanding a process stream with a nitrogen content equal to or greater than that of the feed air, and, then, condensing at least a portion of the expanded stream by a latent heat exchange with at least one of the following two liquids: (i) a liquid at an intermediate height in the lower pressure column and (ii) one of the liquid feeds to low pressure column which has an oxygen concentration of at least the concentration of oxygen in the feed air; (c) condensing at least one process stream with nitrogen content equal to or greater than that in the feed air by latent heat exchange which vaporizes at least a portion of an oxygen-enriched liquid stream which has oxygen concentration of at least the concentration of oxygen in the feed air and which is at a pressure greater than the pressure of the lower pressure column, and work expanding at least a portion of the resulting vapor stream; and (d) work expanding a process stream from the higher pressure column with nitrogen content equal to or greater than that in the feed air and withdrawing the expanded stream as gaseous product stream.

10 Claims, 8 Drawing Sheets

AIR SEPARATION PROCESS USING WARM AND COLD EXPANDERS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to several methods for efficient production of oxygen by cryogenic air separation. In particular, the present invention relates to cryogenic air separation processes where it is attractive to produce at least a portion of the total oxygen with purity less than 99.5% and, preferably, less than 97%.

There are numerous U.S. patents that teach the efficient production of oxygen with purity less than 99.5%. Two examples are U.S. Pat. Nos. 4,704,148 and 4,936,099.

U.S. Pat. No. 2,753,698 discloses a method for the fractionation of air in which the total air to be separated is prefractionated in the high pressure column of a double rectifier to produce a crude (impure) liquid oxygen (crude LOX) bottoms and a gaseous nitrogen overhead. The so produced crude LOX is expanded to a medium pressure and is completely vaporized by heat exchange with condensing nitrogen. The vaporized crude oxygen is then slightly warmed, expanded against a load of power production and scrubbed in the low pressure column of the double rectifier by the nitrogen condensed within the high pressure column and entered on top of the low pressure column. The bottom of the low pressure column is reboiled with the nitrogen from the high pressure column. This method of providing refrigeration will henceforth be referred to as CGOX expansion. In this patent, no other source of refrigeration is used. Thus, the conventional method of air expansion to the low pressure column is replaced by the proposed CGOX expansion. As a matter of fact, it is cited in this patent that the improvement results because additional air is fed to the high pressure column (as no gaseous air is expanded to the low pressure column) and this results in additional nitrogen reflux being produced from the top of the high pressure column. It is stated that the amount of additional nitrogen reflux is equal to the additional amount of nitrogen in the air that is fed to the high pressure column. An improvement in the efficiency of scrubbing with liquid nitrogen in the upper part of the low pressure column is claimed to overcome the deficiency of boil-up in the lower part of the low pressure column.

U.S. Pat. No. 4,410,343 discloses a process for the production of low purity oxygen which employs a low pressure and a medium pressure column, wherein the bottoms of the low pressure column are reboiled against condensing air and the resultant air is fed into both the medium pressure and low pressure columns.

U.S. Pat. No. 4,704,148 discloses a process utilizing high and low pressure distillation columns for the separation of air to produce low purity oxygen and a waste nitrogen stream. Feed air from the cold end of the main heat exchangers is used to reboil the low pressure distillation column and to vaporize the low purity oxygen product. The heat duty for the column reboil and oxygen product vaporization is supplied by condensing air fractions. In this patent, the air feed is split into three substreams. One of the substreams is totally condensed and used to provide reflux to both the low pressure and high pressure distillation columns. A second substream is partially condensed with the vapor portion of the partially condensed substream being fed to the bottom of the high pressure distillation column and the liquid portion providing reflux to the low pressure distillation column. The third substream is expanded to recover refrigeration and then introduced into the low pressure distillation column as column feed. Additionally, the high pressure column condenser is used as an intermediate reboiler in the low pressure column.

In international patent application #PCT/US87/01665 (U.S. Pat. No. 4,796,431), Erickson teaches a method of withdrawing a nitrogen stream from the high pressure column, partially expanding this nitrogen to an intermediate pressure and then condensing it by heat exchange against either crude LOX from the bottom of the high pressure column or a liquid from an intermediate height of the low pressure column. This method of refrigeration will now be referred to as nitrogen expansion followed by condensation (NEC). Generally, NEC provides the total refrigeration need of the cold box. Erickson teaches that only in those applications where NEC alone is unable to provide the refrigeration need that supplemental refrigeration is provided through the expansion of some feed air. However, use of this supplemental refrigeration to reduce energy consumption is not taught. This supplemental refrigeration is taught in the context of a flowsheet where other modifications to the flowsheets were done to reduce the supply air pressure. This reduced the pressure of the nitrogen to the expander and therefore the amount of refrigeration available from NEC.

In U.S. Pat. No. 4,936,099, Woodward et al use CGOX expansion in conjunction with the production of low purity oxygen. In this case, gaseous oxygen product is produced by vaporizing liquid oxygen from the bottom of the low pressure column by heat exchange against a portion of the feed air.

In DE-28 54 508, a portion of the air feed at the high pressure column, pressure is further compressed at the warm level by using work energy from the expander providing refrigeration to the cold box. This further compressed air stream is then partially cooled and expanded in the same expander that drives the compressor. In this scheme, the fraction of the feed air stream which is further compressed and then expanded for refrigeration is the same. As a result, for a given fraction of the feed air, more refrigeration is produced in the cold box. The patent teaches two methods to exploit this excess refrigeration: (i) to produce more liquid products from the cold box; (ii) to reduce flow through the compressor and the expander and thereby increase flow to the high pressure column. It is claimed that an increased flow to the high pressure column would result in a greater product yield from the cold box.

In U.S. Pat. No. 5,309,721, the low pressure column of a double column process is operated at a pressure much higher than the atmospheric pressure. The resulting nitrogen stream from the top of the low pressure column is divided into two streams and each stream is expanded in a different expander operating at different temperature levels.

The U.S. Pat. No. 5,146,756 also teaches the use of two expanders to obtain large temperature differences between the cooling and warming streams in the main heat exchanger that cools the feed air stream for distillation. This is done to reduce the number of main heat exchanger cores. However, in order to operate two expanders, the low pressure column is run at pressures greater than 2.5 bar and a portion of the nitrogen exiting from the top of the low pressure column is expanded in one of the expanders. A portion of the feed air is expanded in the second expander to the low pressure column.

U.S. Pat. No. 4,543,115 teaches a double column process where two different pressure feed air streams are produced by compression and fed to the cold box for separation. The lower pressure air stream is fed to the low pressure distillation column, while the higher pressure air stream is sent to the high pressure column. The double column process produces low purity oxygen and nitrogen products.

U.S. Pat. No. 4,964,901 also teaches the use of two pressure air feeds to the cold box for separation. The lower pressure air stream is about 1.5 to 1.8 bar pressure and is withdrawn from an interstage of the main air compressor. The rest of the air is further compressed to a higher pressure and sent to the high pressure column. The lower pressure air is sent to the low pressure column. The problem with such a process is that a separate adsorbent bed is to be used to remove impurities such as water and carbon dioxide from the lower pressure air stream. Due to the lower pressure, a large quantity of water is present in the lower pressure air stream and this not only increases the size of the adsorbent beds but also the energy required for the regeneration of these beds. This leads to an expensive process.

BRIEF SUMMARY OF THE INVENTION

The present invention relates to a process for the cryogenic distillation of air in a distillation column system having at least one distillation column operating at a higher pressure and one distillation column operating at a lower pressure, wherein feed air is cooled and fed to the higher pressure column, wherein the boil-up at the bottom of the lower pressure column producing the oxygen product is provided by condensing a stream having a nitrogen concentration equal to or greater than that of the feed air stream and wherein at least two expanders are employed to provide refrigeration to the distillation column system, wherein the first expander is operated at an inlet temperature near ambient or above ambient temperature and the second expander is operated at an inlet temperature colder than ambient, characterized in that at least one of the two expanders employs at least one of the following steps: (a) work expanding a portion of the feed air; (b) work expanding a process stream with a nitrogen content equal to or greater than that of the feed air, and, then, condensing at least a portion of the expanded stream by a latent heat exchange with at least one of the following two liquids: (i) a liquid at an intermediate height in the lower pressure column and (ii) one of the liquid feeds to low pressure column which has an oxygen concentration of at least the concentration of oxygen in the feed air; (c) condensing at least one process stream with nitrogen content equal to or greater than that in the feed air by latent heat exchange which vaporizes at least a portion of an oxygen-enriched liquid stream which has oxygen concentration of at least the concentration of oxygen in the feed air and which is at a pressure greater than the pressure of the lower pressure column, and work expanding at least a portion of the resulting vapor stream; and (d) work expanding a process stream from the higher pressure column with nitrogen content equal to or greater than that in the feed air and withdrawing the expanded stream as gaseous product stream.

BRIEF DESCRIPTION OF SEVERAL VIEWS OF THE DRAWINGS

In FIGS. 1 through 5, common streams use the same stream reference numbers.

DETAILED DESCRIPTION OF THE INVENTION

Figure 1:
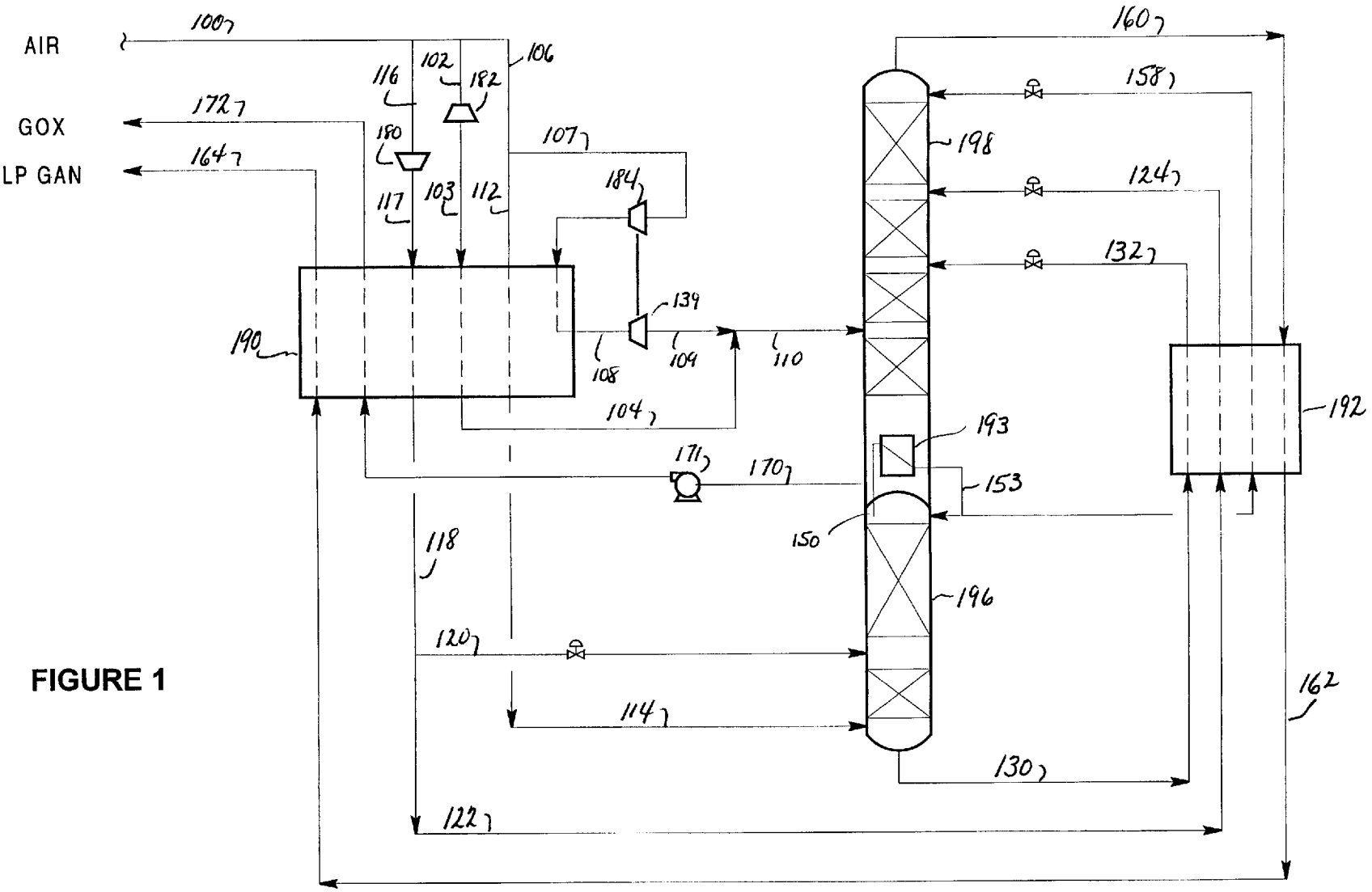
FIGS. 1 through 5 illustrate schematic diagrams of different embodiments of the present invention.

The present invention teaches a more energy efficient and cost effective cryogenic process for the production of low purity oxygen. The low-purity oxygen is defined as a product stream with oxygen concentration less than 99.5% and preferably less than 97%. In this method, the feed air is distilled by a distillation system that contains at least two distillation columns. One distillation column operates at higher pressure (HP column), while the other column operates at a lower pressure (LP column). The boil-up at the bottom of the LP distillation column is provided by condensing a stream whose nitrogen concentration is either equal to or greater than that in the feed air stream. The invention employs at least two expanders in the process, wherein the first expander is operated at an inlet temperature near ambient or above ambient temperature and the second expander is operated at an inlet temperature colder than ambient. In the present invention, at least one of the two expanders employs at least one of the following steps:

(a) work expanding a portion of the feed air;

(b) work expanding a process stream with a nitrogen content equal to or greater than that of the feed air, and, then, condensing at least a portion of the expanded stream by a latent heat exchange with at least one of the following two liquids: (i) a liquid at an intermediate height in the lower pressure column and (ii) one of the liquid feeds to low pressure column which has an oxygen concentration of at least the concentration of oxygen in the feed air;

(c) condensing at least one process stream with nitrogen content equal to or greater than that in the feed air by latent heat exchange which vaporizes at least a portion of an oxygen-enriched liquid stream which has oxygen concentration of at least the concentration of oxygen in the feed air and which is at a pressure greater than the pressure of the lower pressure column, and work expanding at least a portion of the resulting vapor stream; and (d) work expanding a process stream from the higher pressure column with nitrogen content equal to or greater than that in the feed air and withdrawing the expanded stream as gaseous product stream.

In the process of the present invention, at least two expanders are used where any of the above alternative methods are used for either one or both the expanders such that the temperature of the inlet stream to the first expander is either near ambient or above ambient temperature and the second expander provides at least a fraction of the refrigeration need of the plant.

Generally, the second expander that provides the refrigeration of the plant has the inlet stream temperature much lower than the ambient temperature. In this description, such an expander is referred to as a cold expander. Similarly, the first expander that has the inlet stream temperature at near ambient or higher than ambient is referred to as a warm expander.

In the most preferred mode, the distillation system is comprised of a double column system consisting of a higher pressure (HP) column and a lower pressure (LP) column. At least a portion of the feed air is fed to the HP column. The product oxygen is produced from the bottom of the LP column. The process stream in alternative (a) or the process stream in alternative (c) is generally a high pressure nitrogen-rich vapor stream withdrawn from the HP column. If the work expansion method of alternative (a) is used, then the high pressure nitrogen-rich vapor stream is expanded and then condensed by latent heat exchange against a liquid stream at an intermediate height of the LP column or the crude liquid oxygen (crude LOX) stream that originates at the bottom of the HP column and forms the feed to the LP column. In this method, the pressure of the crude LOX stream is dropped to the vicinity of the LP column pressure. The high pressure nitrogen-rich stream can be partially warmed prior to expansion. If the work expansion method of alternative (c) is used, then the high pressure nitrogen-rich stream is condensed by latent heat exchange against at least a portion of the crude LOX stream that is at a pressure higher than the LP column pressure, and the resulting vapor from the at least partial vaporization of the crude LOX is work expanded to the LP column. Prior to the work expansion, the resulting vapor from the at least partial vaporization of the crude LOX could be partially warmed. As an alternative to the crude LOX vaporization, an oxygen-enriched liquid with oxygen content greater than air could be withdrawn from the LP column and pumped to the desired pressure greater than the LP column pressure prior to at least partial vaporization.

By work expansion, it is meant that when a process stream is expanded in an expander, it generates work. This work may be dissipated in an oil brake, or used to generate electricity or used to directly compress another process stream.

Along with low-purity oxygen, other products can also be produced. This includes high purity oxygen (purity equal to or greater than 99.5%), nitrogen, argon, krypton and xenon. Also, when needed, liquid products could also be coproduced.

Now the invention will be described in detail with reference to FIG. 1. The compressed feed air stream free of heavier components such as water and carbon dioxide is shown as stream 100. The feed air stream is divided into three streams, 102, 106 and 116. The major fraction stream 106 is further divided into two streams, 107 and 112. Stream 112 is cooled in the main heat exchanger 190 and then fed as stream 114 to the bottom of the high pressure (HP) column 196. The feed to the high pressure column is distilled into high pressure nitrogen vapor stream 150 at the top and the crude liquid oxygen (crude LOX) stream 130 at the bottom. The crude LOX stream is subcooled in subcooler 192 and fed to a low pressure (LP) column 198 where it is distilled to produce a lower-pressure nitrogen vapor stream 160 at the top and a liquid oxygen product stream 170 at the bottom. Alternatively, oxygen product may be withdrawn from the bottom of the LP column as vapor. The liquid oxygen product stream 170 is pumped by pump 171 to a desired pressure and then vaporized by heat exchange against a suitably pressurized process stream to provide gaseous oxygen product stream 172. In FIG. 1, the suitably pressurized process stream is a fraction of feed air in line 118. The boil-up at the bottom of the LP column is provided by condensing the high pressure nitrogen stream in line 150 to provide high pressure liquid nitrogen stream 153. A portion of this high pressure liquid nitrogen stream provides reflux to the HP column and another portion is subcooled in subcooler 192 to provide subcooled liquid nitrogen stream 158. This subcooled liquid nitrogen stream 158 is then sent as reflux to the LP column.

In FIG. 1, in order to vaporize the pumped liquid oxygen from pump 171, a portion of the feed air stream 100 in stream 116 is further boosted in an optional booster 180 and cooled against cooling water (not shown in the figure) and then cooled in the main heat exchanger 190 by heat exchange against the pumped liquid oxygen stream. A portion of the cooled liquid air stream 118 is sent to the HP column (stream 120) and another portion (stream 122) is sent to the LP column after some subcooling in subcooler 192.

In the invention of FIG. 1, the two expanders used are 139 and 182, and in both the expanders, fractions of the feed air stream according to expansion alternative (a) are used. Thus, feed air fraction stream 102 which is slightly above ambient temperature is work expanded in warm expander 182 to a pressure close to the LP column pressure. This expanded stream 103 is then cooled in the main heat exchanger 190 and fed to an appropriate location in the LP column. In the preferred mode, the temperature of stream 102 prior to work expansion should be much higher than the ambient temperature. This higher temperature can be achieved through heat exchange between stream 102 and a suitable heat source. If after expansion in warm expander 182, the temperature of stream 103 is higher than the ambient temperature then it should be cooled to temperatures similar to the other air streams (117 or 112) to the main heat exchanger.

The second expander according to the invention in FIG. 1 is cold expander 139. This cold expander provides the refrigeration for the plant. For this purpose, the portion of the feed air stream 107 is boosted in pressure by booster 184. This boosted stream is first cooled by heat exchange with cooling water (not shown in the figure) and then further cooled in the main exchanger 190 to provide stream 108. This further cooled stream 108 is expanded in cold expander 139 and fed to an appropriate location in the LP column. Note that generally the temperature of the inlet stream 108 to cold expander 139 is much below the ambient temperature. The work energy extracted from cold expander 139 is used to drive booster 184. In an alternative mode, booster 184 may not be used to boost air stream 107 and instead stream 107 could be directly fed to the main heat exchanger without any pressure boosting to provide further cooled stream 108.

Several known modifications can be applied to the example flowsheet in FIG. 1. For example, liquid nitrogen reflux to the LP column may not be obtained from the high pressure liquid nitrogen stream 153 but from an intermediate location of the HP column. In such a case, a nitrogen product stream may be withdrawn from the top of the HP column. It could be a portion of the high pressure gaseous nitrogen stream 150 and/or a portion of high pressure liquid nitrogen stream 153.

Figure 2:
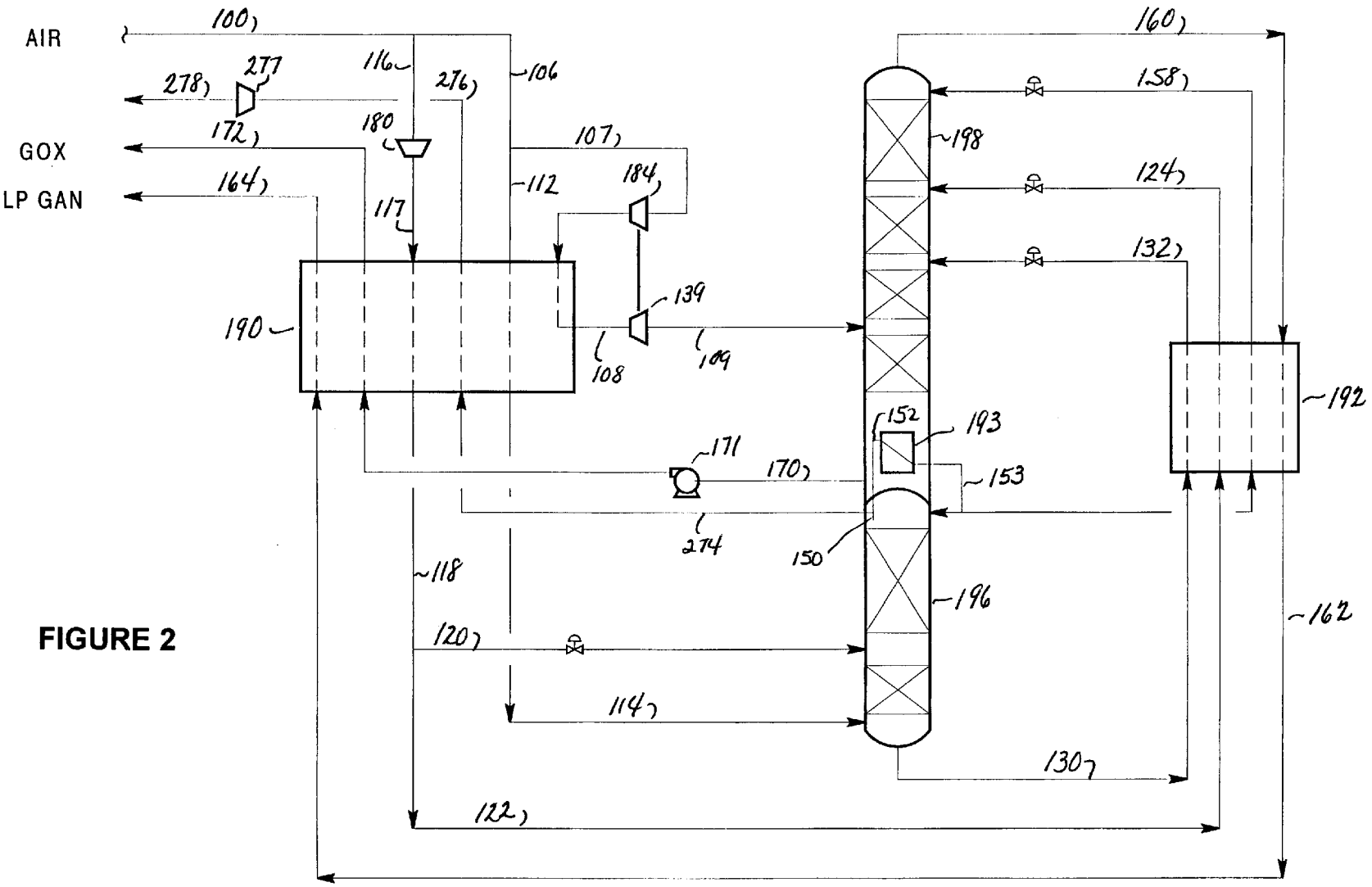

FIG. 2 shows an alternative embodiment where a process stream is work expanded according to expansion alternative (d) in one of the expanders. While one has a choice to expand a process stream withdrawn from the HP column in either the warm expander or the cold expander, in FIG. 2 this expansion is done in the warm expander. Thus to obtain the system of FIG. 2, the warm expander 182 and the associated air streams in FIG. 1 are eliminated and in its place warm expander 277 is added. The feed stream 276 for the warm expander 277 is obtained by withdrawing a portion of the high pressure nitrogen vapor stream from the top of the HP column (stream 274) and warming it up in the main heat exchanger. The expanded stream 278 could be used as a product stream. In a preferable mode of FIG. 2, the high pressure nitrogen stream 276 should be further warmed prior to expansion by heat exchange with another heat source. This could increase the work output from warm expander 277. In an alternative mode, the high pressure stream 274 may not be withdrawn from the top of the HP column but from a location below the top of this column.

Figure 3:
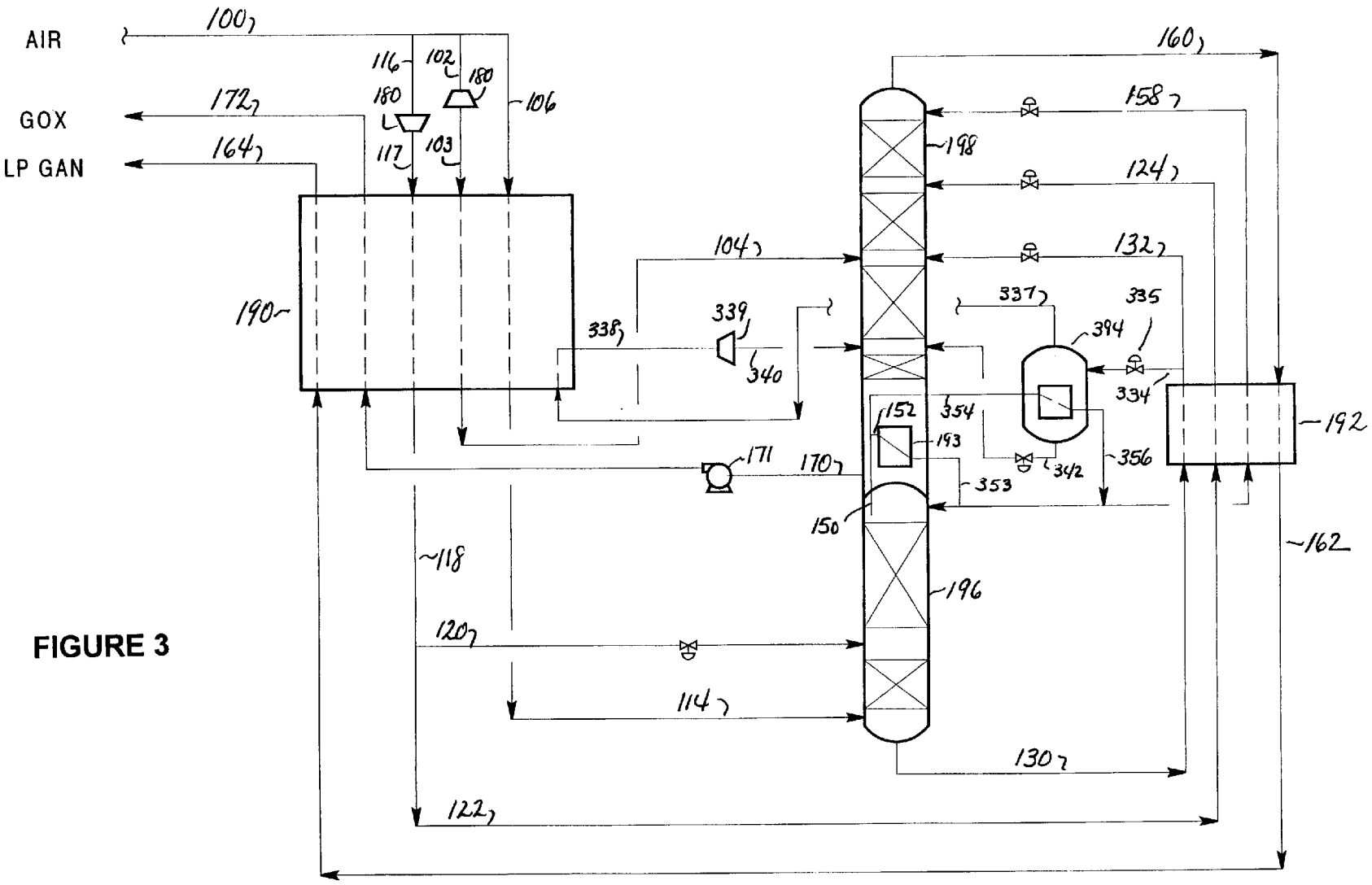

FIG. 3 shows a process of the present invention where, from the process of FIG. 1, cold expander 139 is replaced by a cold expander 339 using the expansion alternative (c). Thus according to the invention, at least a portion of the crude LOX stream having a concentration of oxygen greater than that in feed air is reduced in pressure across valve 335 to a pressure which is intermediate of the HP and LP column pressures. In FIG. 3, prior to pressure reduction, crude LOX is subcooled in subcooler 192 by heat exchange against the returning gaseous nitrogen stream from the LP column. This subcooling is optional. The pressure-reduced crude LOX stream 336 is sent to a reboiler/condenser 394, where it is at least partially boiled by the latent heat exchange against the second portion of the high pressure nitrogen stream from line 150 in line 354 (the process stream of expansion alternative (c)) to provide the second high pressure liquid nitrogen stream 356. The first and second high pressure liquid nitrogen streams provide the needed reflux to the HP and LP columns. The vaporized portion of the pressure-reduced crude LOX stream in line 337 (hitherto referred as crude GOX stream) is partially warmed in the main heat exchanger 190 and then work expanded in cold expander 339 to the LP column as an additional feed. Partial warming of crude GOX stream 337 is optional and similarly, after work expansion, stream 340 could be further cooled prior to feeding it to the LP column.

Several known modifications can be applied to the example flowsheet in FIG. 3. For example, all the crude LOX stream 130 from the HP column may be sent to the LP column and none of it is sent to the reboiler/condenser 394. In lieu of this, a liquid is withdrawn from an intermediate height of the LP column and then pumped to a pressure intermediate of the HP and LP column pressures and sent to the reboiler/condenser 394. The rest of the treatment in reboiler/condenser 394 is analogous to that of stream 334 explained earlier. In another modification, the two high pressure nitrogen streams 352 and 354 condensing in reboilers/condensers 393 and 394, respectively, may not originate from the same point in the HP column. Each one may be obtained at different heights of the HP column and after condensation in their reboilers (393 and 394), each is sent to an appropriate location in the distillation system. As one example, stream 354 could be drawn from a position which is below the top location of the high pressure column, and after condensation in reboiler/condenser 394, a portion of it could be returned to an intermediate location of the HP column and the other portion sent to the LP column.

Figure 4:
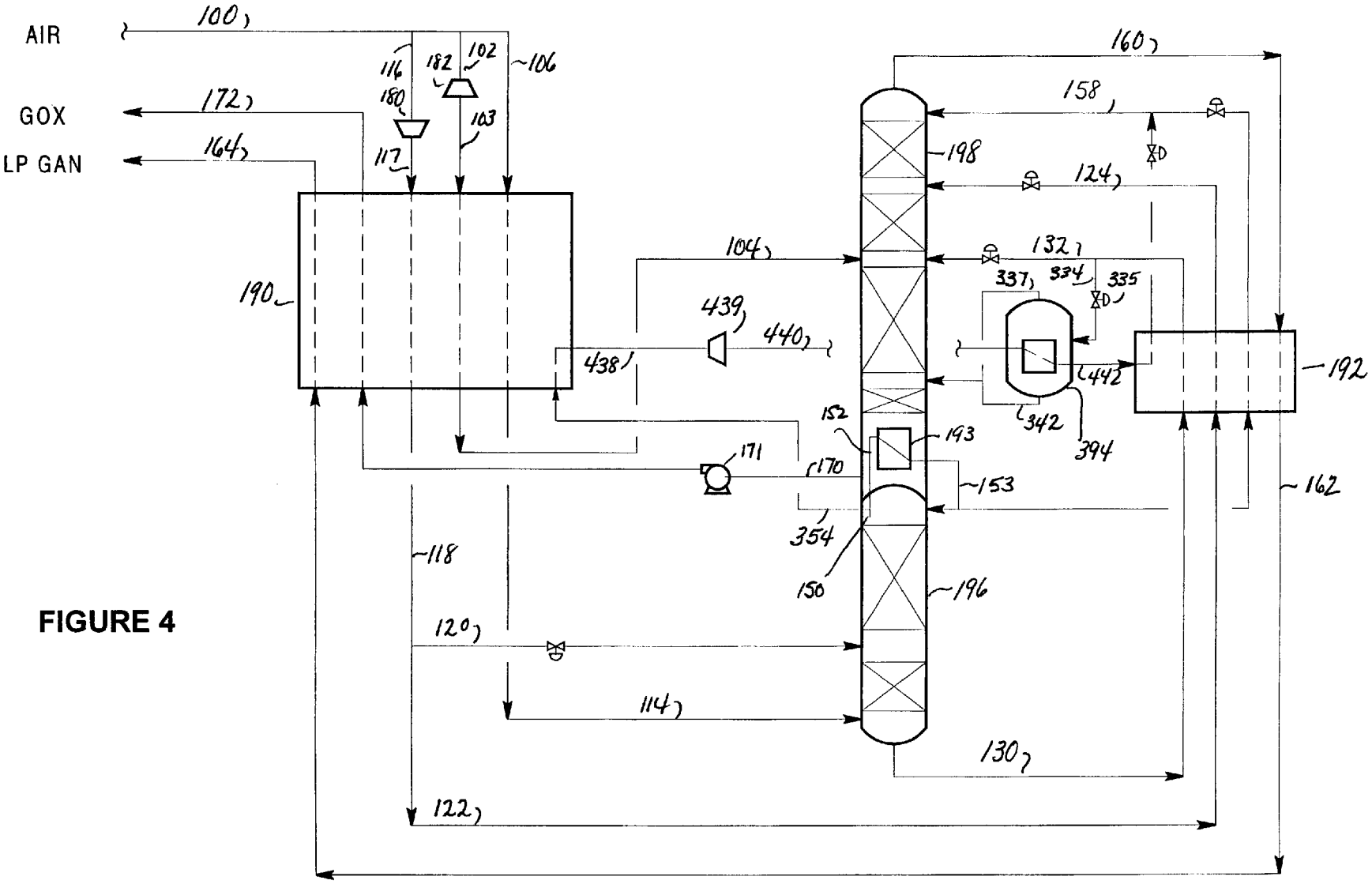

FIG. 4 shows an alternative embodiment where a process stream is work expanded in the cold expander according to expansion alternative (b)(ii). Here subcooled crude LOX stream 334 is let down in pressure across valve 335 to a pressure that is very close to the LP column pressure and then fed to the reboiler/condenser 394. The second portion of the high pressure nitrogen stream in line 354 (now the process stream of expansion alternative (a)) is partially warmed (optional) in the main heat exchanger and then work expanded in expander 439 to provide a lower pressure nitrogen stream 440. Stream 440 is then condensed by latent heat exchange in reboiler/condenser 394 to provide stream 442, which after some subcooling is sent to the LP column. The vaporized stream 337 and the liquid stream 342 from the reboiler/condenser 394 are sent to an appropriate location in the LP column. If needed, a portion of the condensed nitrogen stream in line 442 could be pumped to the HP column. Once again, the two nitrogen streams, one condensing in reboiler/condenser 393 and the other condensing in reboiler/condenser 394, could be drawn from different heights of the HP column and could therefore be of different composition.

Another variation of FIG. 4 using the cold expander according to expansion alternative (b)(ii) could also be used. In this scheme, all of the crude LOX stream from the bottom of the HP column is sent without any vaporization to the LP column. In place of reboiler/condenser 394, an intermediate reboiler/condenser is used at an intermediate height of the LP column. Now the work expanded nitrogen stream 440 from expander 439 is condensed in this intermediate reboiler/condenser by latent heat exchange against a liquid at the intermediate height of the LP column. The condensed nitrogen stream is treated in a manner which is analogous to that in FIG. 4.

Figure 5:
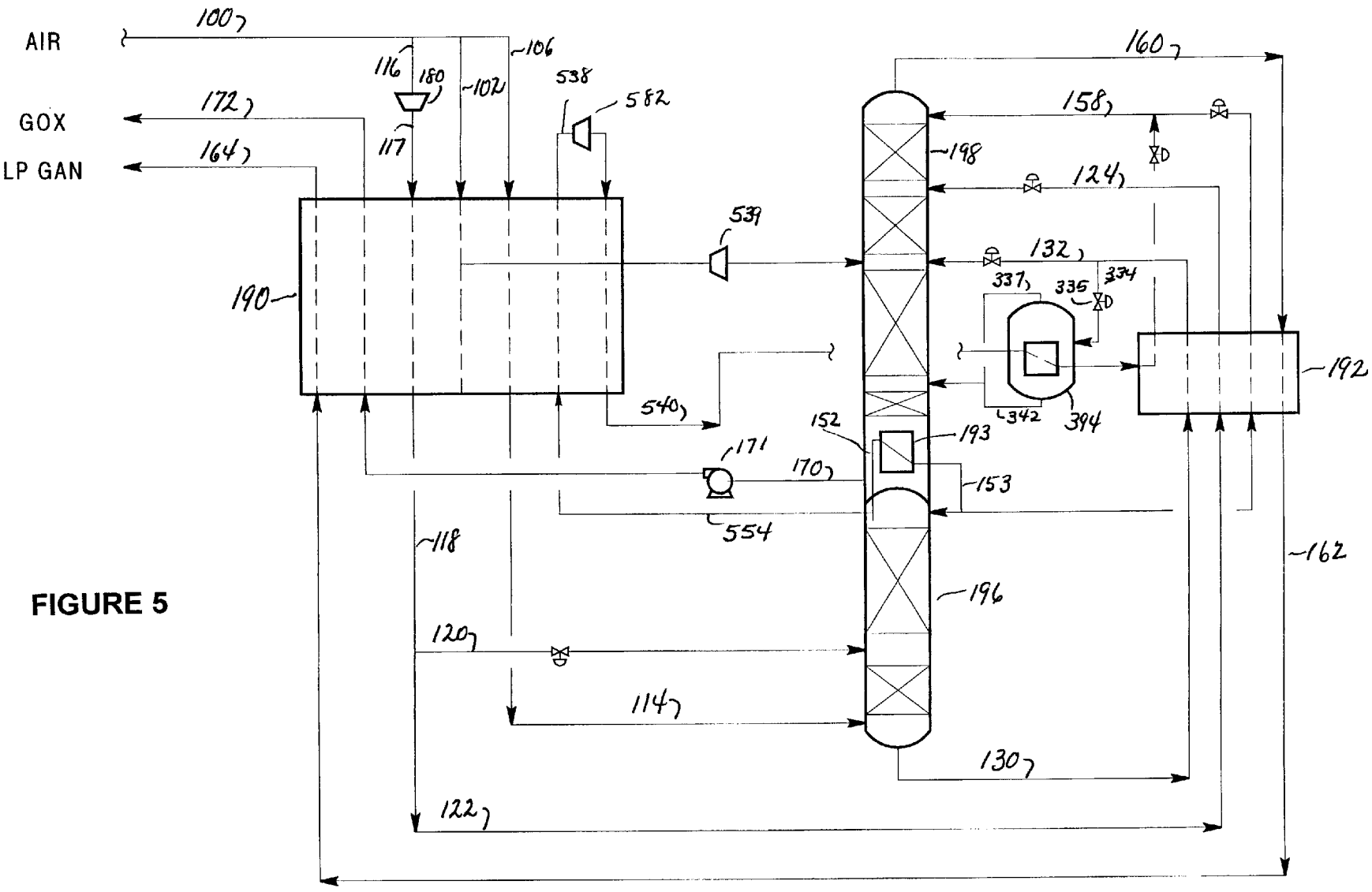

The process in FIG. 5 demonstrates how the process streams of warm and cold expanders may be interchanged. In FIG. 4, a portion of the feed air stream is expanded in the warm expander and a high pressure nitrogen steam from HP column is expanded in the cold expander. In FIG. 5, the high pressure nitrogen stream is expanded in the warm expander and a portion of the feed air stream is expanded in the cold expander. Thus, the portion of air stream in line 102 is now partially cooled in the main heat exchanger and then expanded in the cold expander 539 and fed to the LP column. The high pressure nitrogen stream 554 from the top of the HP column is warmed in the main heat exchanger to a temperature close to the ambient temperature (stream 538) and then expanded in the warm expander 582. The expanded stream from the warm expander is then further cooled in the main heat exchanger to provide stream 540. Further treatment of stream 540 is analogous to stream 440 in FIG. 4. In order to extract more work from warm expander 582, the high pressure nitrogen stream 538 should be further heated with an alternative heat source prior to the expansion in the warm expander.

Figure 6:
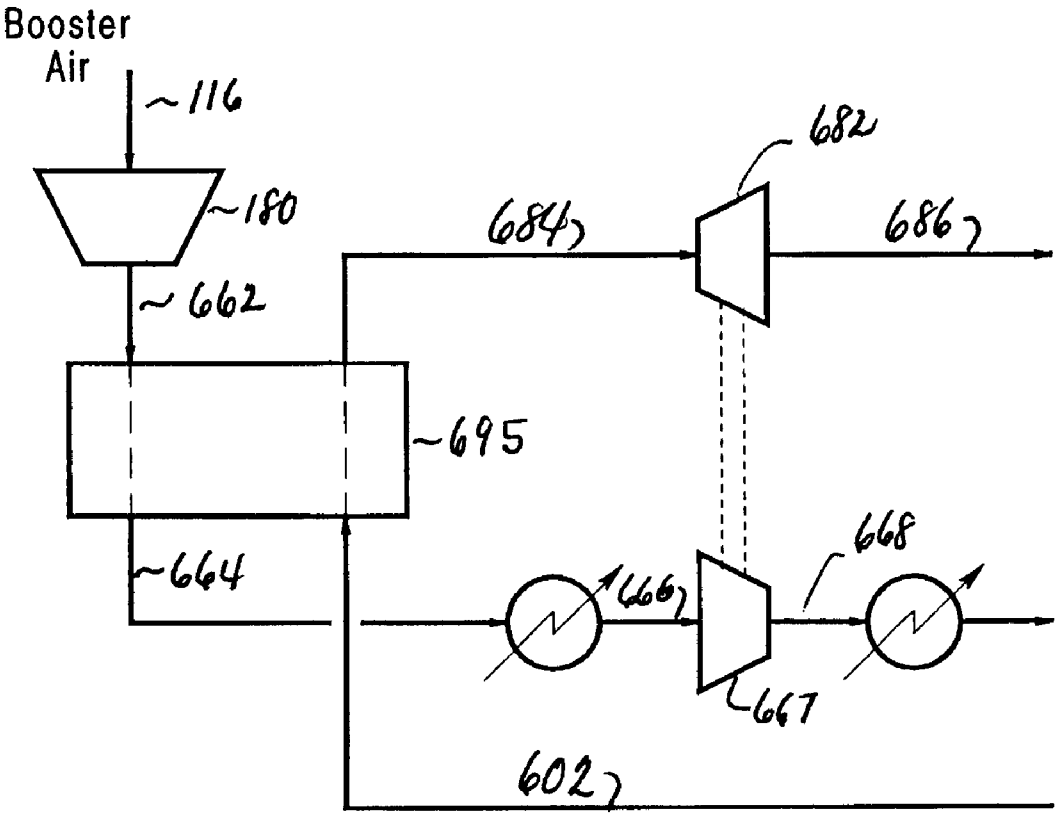
FIG. 6 illustrates schematic diagrams of a scheme useful in the present invention for the recovery of low-level heat.

As started earlier, the inlet stream to the warm expander can be heated by heat exchange with a suitable heat source. This will increase the work output of the warm expander. Some examples of heat source include steam, hot water, hot gas stream, a burner, etc. This warm expander can beneficially recover a low-level heat. A useful scheme for recovering low-level heat is shown in FIG. 6. Here heat available from a warm gas stream exiting a compressor may be used to preheat the stream to the warm expander. In FIG. 6, heat from the further boosted air stream from booster 180 of FIG. 1 is used for this purpose. Thus, the warm further boosted air stream in line 662 from booster 180 is cooled in heat exchanger 695 by heat exchange against a process stream in line 602. The warmed process stream 684 is then work expanded in warm expander 682. The further boosted cooled air stream in line 664 is further cooled with cooling water (stream 666) and can be directly fed to the main heat exchanger to vaporize the pumped liquid oxygen. However, in FIG. 6 an option is shown whereby the stream in line 666 is again boosted in pressure by booster 667 using the work energy from warm expander 682. In FIG. 6, if needed, stream 686 exiting the warm expander 682 may be cooled by using cooling water. In this Figure, stream 602 represents any process stream that is to be work expanded in the warm expander. Thus, stream 602 will be the same as stream 102 in FIG. 1, or stream 276 in FIG. 2, or stream 538 in FIG. 5, etc.

In FIGS. 1, 3 and 4, the air stream to the warm expander is shown to be at the same pressure as the feed air stream to the HP column. While this is the preferred mode, it is not essential that the two pressures be the same. For example, the pressure of stream 102 in FIG. 1 could be lower or higher than that of stream 106. However, in general, the pressure of stream 102 will either be the same or lower than that of stream 106.

So far all the example flowsheets show either one or two reboiler/condensers. However, it should be emphasized that the present invention does not preclude the possibility of using additional reboilers/condensers in the LP column than those shown in FIGS. 1–5. If needed, more reboilers/condensers may be used in the bottom section of the LP column to further distribute the generation of vapor in this section. Any suitable process stream may be either totally or partially condensed in these additional reboilers/condensers. Also, the possibility of condensing a vapor stream withdrawn from an intermediate height of the HP column in a reboiler/condenser located in the LP column may be considered.

In all, the process schemes of the present invention, where work is extracted by the expansion alternative (b), all of the process stream after work expansion may not be condensed by latent heat exchange as taught by this alternative. A portion of this stream may be recovered as a product stream or used for some other purpose in the process scheme. For example, in the process schemes shown in FIG. 4, at least a portion of the high pressure nitrogen stream from the high pressure column is work expanded in expander 439 according to the expansion alternative (b) of the invention. A portion of the stream exiting the expander 439 may be further warmed in the main heat exchanger and recovered as a nitrogen product at medium pressure.

All the work extracted from the warm expander of the invention is to be used external to the cold box. Generally, but not necessarily, all the work extracted from the cold expander is also used external to the cold box, however, at least a portion of this extracted work must be used external to the cold box. For this purpose, either one or both the expanders may be generator loaded to generate electricity or loaded with a warm compressor to compress a process stream at ambient or above ambient temperatures. Some examples of process streams that could be compressed in such a warm compressor are: the further pressurized air stream (stream 117 in FIG. 1) that eventually condenses by heat exchange with pumped liquid oxygen, a product nitrogen stream (all or a fraction of stream 164 in FIG. 1), a gaseous oxygen stream (line 172 in FIG. 1).

The process of the present invention is also capable of efficiently coproducing a high pressure nitrogen product stream from the HP column. This high pressure nitrogen product stream can be withdrawn from any suitable location of the HP column. This feature is not shown in any of the flowsheets I through 5 but is an essential part of the present invention.

Finally, the method taught in the present invention can be used when there are coproducts besides the low-purity oxygen, with oxygen content less than 99.5%. For example, a high purity (99.5% or greater oxygen content) oxygen could be coproduced from the distillation system. One method of accomplishing this task is to withdraw low-purity oxygen from the LP column at a location which is above the bottom and withdraw a high purity oxygen from the bottom of the HP column. If the high purity oxygen stream is withdrawn in the liquid state, then it could be further boosted in pressure by a pump and then vaporized by heat exchange against a suitable process stream. Similarly, a high purity nitrogen product stream at elevated pressure could be coproduced. One method of accomplishing this task would be to take a portion of the condensed liquid nitrogen stream from one of the suitable reboilers/condensers and pump it to the required pressure and then vaporize it by a suitable process stream.

Figure 7:
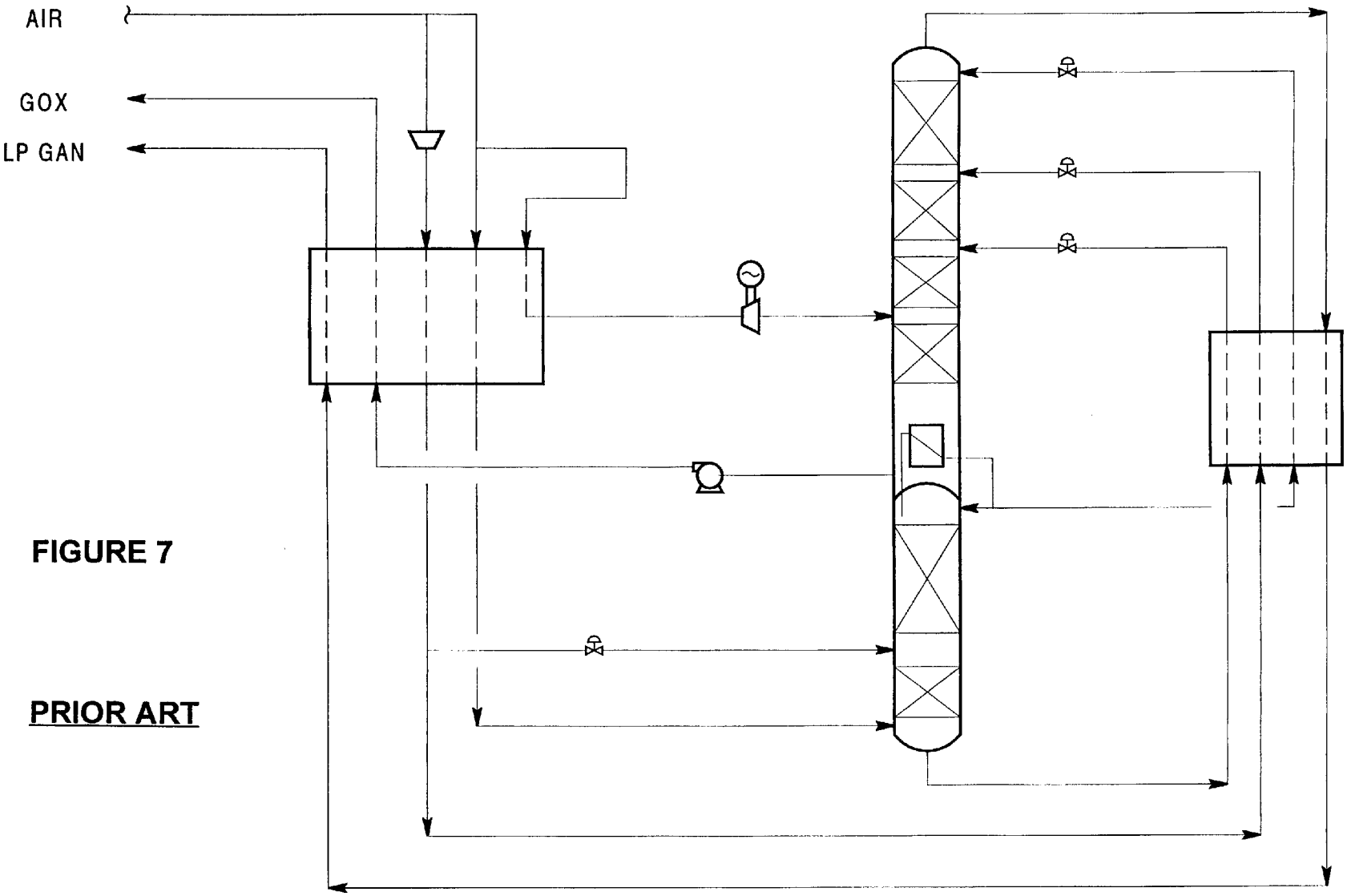
FIGURE 7 PRIOR ART
FIGS. 7 and 8 illustrate schematic diagrams of two prior art processes.

The value of the present invention is that it leads to substantial reduction in the energy consumption. This can be easily understood by comparing it with some known prior art processes, which are listed below:

The first prior art process is shown in FIG. 7. This is a conventional double column process with a cold air expander to the LP column. The work energy from the air expander is recovered as electrical energy. The process of FIG. 7 can be easily derived from the process of FIG. 1 by eliminating warm expander 182, booster 184 and the associated line. Stream 107 is directly fed to the main heat exchanger, partially cooled and sent to the cold expander.

Figure 8:
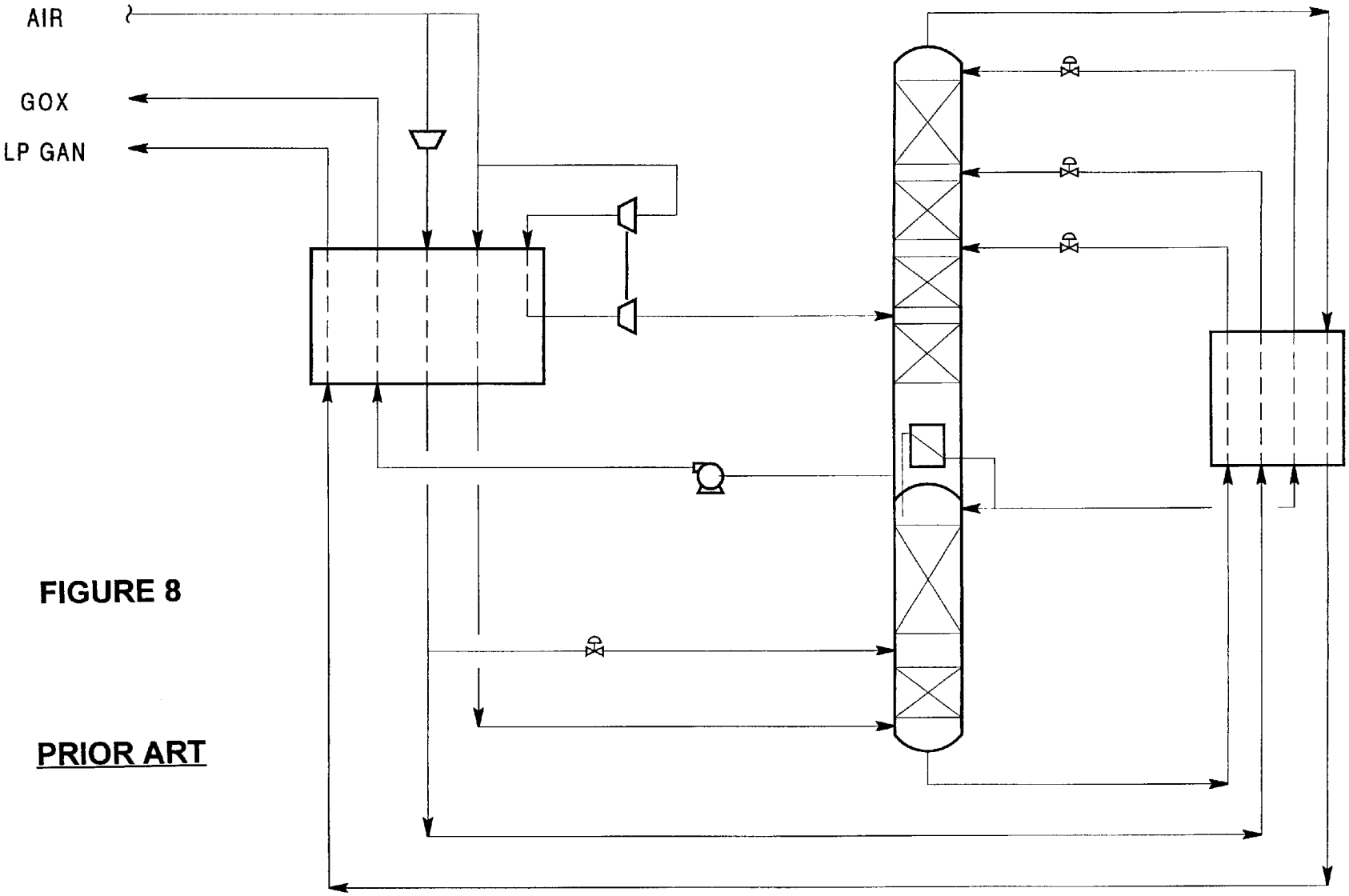
FIGURE 8 PRIOR ART

The second prior art process is according to DE-2854508 and is shown in FIG. 8. This process is easily derived from FIG. 1 by eliminating warm expander 182 and the associated lines. This process is similar to the one shown in FIG. 7 except that the stream to be expanded is first compressed in a compressor which is mechanically linked to the expander.

The superior performance of the present invention as compared to the prior art process becomes clear when process of FIG. 1 is compared with the two prior art processes of FIGS. 7 and 8. For a given feed air pressure, the only difference between FIGS. 1 and 8 is the use of warm expander 182. By expanding a portion of the feed air in warm expander 182, work energy is recovered in FIG. 1. This work energy can be used to either generate electricity or compress a suitable process stream. This clearly leads to a reduction in the overall energy demand of the plant. Specially(??) when the LP column pressure is near ambient, it is well known that a large fraction of feed air can be expanded (up to 25%) without having significant impact on oxygen recovery. Therefore, up to 25%, but preferably only up to 15%, of the feed air could be expanded in the warm expander. The exact amount to be expanded will depend on specific applications. For example, optimal cold expander flow is dependent on the amount of heat leak and liquid production.

The present invention is even more suited for the processes shown in FIGS. 3–5. U.S. Pat. No. 2,753,698 teaches the use of crude GOX expansion as shown for cold expander 339 in FIG. 3. U.S. Pat. No. 4,796,431 teaches the cold expander technique of FIG. 4. Both these patents, however, fail to exploit the beneficial aspect of energy recovery through a warm expander. In these processes, the total boil-up and reflux available for the LP column is generally greater than the processes of FIGS. 7 and 8. As a result, a much larger fraction of air can be sent to the warm expander in FIGS. 3 and 4. This will lead to even greater energy savings.

When compared to U.S. Pat. No. 4,964,901, the present invention does not require that water be removed from an air stream that is at a very low pressure of 1.5 to 1.8 bar. This reduces the size of adsorbent beds and the energy needed for adsorbent bed regeneration. Furthermore, in most cases, the present invention eliminates the need for having two sets of adsorbent beds to treat feed air at two different pressures. Now all the feed air is compressed to one pressure and sent to one set of adsorbent beds. This leads to further simplification of the process.

The present invention is particularly more useful when the HP column pressure is greater than about 60 psia (4 bar absolute) and less than about 160 psia (11 bar absolute). The reason being that, generally, operation of a high pressure column less than 60 psia requires that a portion of the feed air stream is condensed in the bottom reboiler of the LP column. This decreases the amount of liquid nitrogen reflux available to the distillation columns. The use of a warm air expander would further decrease the amount of liquid nitrogen reflux. Furthermore, since the inlet pressure to expander is now lower, the amount of work extracted is not large. As a result, the process of present invention will be less attractive when the HP column pressure is substantially below 60 psia. For HP column pressures greater than 160 psia, the need for liquid nitrogen reflux by the distillation column increases sharply and in this case, use of a warm feed air expander to the LP column could become unattractive.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

We claim:

1. In a process for the cryogenic distillation of air in a distillation column system having at least one distillation column operating at a higher pressure and one distillation column operating at a lower pressure, wherein feed air is cooled and fed to the higher pressure column, wherein the boil-up at the bottom of the lower pressure column producing the oxygen product is provided by condensing a stream having a nitrogen concentration equal to or greater than that of the feed air stream and wherein at least two expanders are employed to provide refrigeration to the distillation column system, wherein the first expander is operated at an inlet temperature near ambient or above ambient temperature and the second expander is operated at an inlet temperature colder than ambient, characterized in that at least one of the two expanders employs at least one of the following steps:

(a) work expanding a portion of the feed air;

(b) work expanding a process stream with a nitrogen content equal to or greater than that of the feed air, and, then, condensing at least a portion of the expanded stream by a latent heat exchange with at least one of the following two liquids: (i) a liquid at an intermediate height in the lower pressure column and (ii) one of the liquid feeds to low pressure column which has an oxygen concentration of at least the concentration of oxygen in the feed air;

(c) condensing at least one process stream with nitrogen content equal to or greater than that in the feed air by latent heat exchange which vaporizes at least a portion of an oxygen-enriched liquid stream which has oxygen concentration of at least the concentration of oxygen in the feed air and which is at a pressure greater than the pressure of the lower pressure column, and work expanding at least a portion of the resulting vapor stream; and (d) work expanding a process stream from the higher pressure column with nitrogen content equal to or greater than that in the feed air and withdrawing the expanded stream as gaseous product stream.

2. The process according to claim 1 wherein the first expander carries out process step (d) and the second expander carries out process step (a).

3. The process according to claim 1 wherein the first expander carries out process step (d) and the second expander carries out process step (b).

4. The process according to claim 1 wherein the first expander carries out process step (d) and the second expander carries out process step (c).

5. The process according to claim 1 wherein the first expander carries out process step (a) and the second expander carries out process step (b).

6. The process according to claim 1 wherein the first expander carries out process step (a) and the second expander carries out process step (c).

7. The process according to claim 1 wherein the first expander carries out process step (a) and the second expander carries out process step (a).

8. The process according to claim 1 wherein the inlet stream to the first expander is warmed prior to expansion by indirect heat exchange with an external heat source.

9. The process according to claim 8 wherein the external source of heat is an above ambient temperature compressed gas stream.

10. The process according to claim 9 wherein the above ambient temperature compressed gas stream is a discharge flow from a compressor.

* * * * *